US005594303A

United States Patent [19]

Simpson et al.

[11] Patent Number: 5,594,303

[45] Date of Patent: Jan. 14, 1997

[54] APPARATUS FOR EXCITING AN ELECTRODELESS LAMP WITH AN INCREASING ELECTRIC FIELD INTENSITY

[75] Inventors: James Simpson; Mohammad Kamarehi, both of Gaithersburg; Michael Ury, Bethesda; Brian Turner, Myersville, all of Md.

[73] Assignee: Fusion Lighting, Inc., Rockville, Md.

[21] Appl. No.: 402,065

[22] Filed: Mar. 9, 1995

[51] Int. Cl.[6] ..... H01J 65/04

[52] U.S. Cl. ..... 315/39; 315/248; 315/344

[58] Field of Search ..... 315/39, 248, 344

[56] References Cited

U.S. PATENT DOCUMENTS

| | | | |
|---|---|---|---|
| 3,942,058 | 3/1976 | Haugsjaa et al. | 315/39 X |
| 4,749,915 | 6/1988 | Lynch et al. | 315/39 X |
| 4,887,008 | 12/1989 | Wood | 315/39 |
| 4,887,192 | 12/1989 | Simpson et al. | 315/39 X |
| 4,954,755 | 9/1990 | Lynch et al. | 315/248 |
| 4,975,625 | 12/1990 | Lynch et al. | 315/39 X |
| 5,227,698 | 7/1993 | Simpson et al. | 315/298 |
| 5,361,274 | 11/1994 | Simpson et al. | 315/39 X |

FOREIGN PATENT DOCUMENTS

| | | | |
|---|---|---|---|
| 126250 | 10/1981 | Japan | 315/39 |

*Primary Examiner*—Benny T. Lee

*Attorney, Agent, or Firm*—Pollock, Vande Sande & Priddy

[57] ABSTRACT

Apparatus for efficiently exciting an electrodeless lamp to produce visible light. A source of microwave energy is coupled to a cylindrical cavity which encloses an electrodeless lamp. The cylindrical cavity includes a sidewall and end wall which is made from a metallic mesh which passes light produced from the electrodeless lamp. The electric field intensity within the cylindrical cavity is increased in the region above the lamp center. The increased electric field intensity produces a more uniform temperature across the bulb service, increasing the rate of plasma heating of gas molecules in the lamp.

10 Claims, 5 Drawing Sheets

APPARATUS FOR EXCITING AN ELECTRODELESS LAMP WITH AN INCREASING ELECTRIC FIELD INTENSITY

The present invention relates to the field of apparatus for exciting electrodeless lamps. Specifically, an apparatus for uniformly radiating an electrodeless lamp with improved illumination efficiency is described.

Electrodeless lamps have been employed in the past to generate high intensity radiant light in excess of 100,000 lumens. These devices are used in industrial lighting in both indoor and outdoor applications. Among the advantages of electrodeless lamps is an enhanced life of between 10,000 and 20,000 hours. Further, greater power efficiency is obtained than with other conventional light sources.

Electrodeless lamps may be designed to emit mostly infrared light, ultraviolet light or visible light. In applications wherein visible light is needed, electrodeless lamps are sulfur or selenium filled to produce mostly visible light. Other lamps of other materials, such as mercury, can be used to generate ultraviolet and infrared light in industrial applications where these wavelengths of light are needed.

Sulfur and selenium filled lamps have a light output which can be affected by local temperatures within the lamp. These gas-filled lamps show dark bands, particularly along the top thereof, when the lamp surface is not uniformly heated. Cooler portions of the lamp can produce discoloration which absorbs light disproportionately from the remaining portion of the lamp surface. Temperature differentials within the bulb are very often the result of an uneven field distribution of the microwave energy which is supported by a resonant cavity containing the lamp. The uneven field distribution produces an uneven discharge which in turn produces "sludge", a dark gas containing higher order sulfur molecules which degrade the lamp's performance. Therefore, in order to avoid the consequences of local temperature differentials within the lamp, the microwave illumination of the bulb should produce a uniform temperature across the surface of the lamp.

Other circumstances which impact on the efficiency of illumination of the electrodeless lamp include interaction of the fringe field produced between the microwave energy source and the cavity with the electrodeless lamp. The lamp can distort the coupling fields between cavity and microwave energy source, introducing an impedance mismatch and consequent power loss, lowering the system's efficiency.

SUMMARY OF THE INVENTION

It is an object of this invention to efficiently illuminate an electrodeless lamp with microwave energy.

It is a more specific object of this invention to provide for a microwave illumination field which heats an electrodeless lamp uniformly over its entire surface.

It is yet another object of this invention to increase the amount of visible light generated by a microwave illuminated electrodeless lamp.

These and other objects of the invention are provided for by a microwave illumination system which improves the electromagnetic field distribution about an electrodeless lamp so that portions of the lamp which run cooler are exposed to an ascending or increasing electric field intensity. The electrodeless lamp is supported for rotation in a cylindrical cavity about the cavity axis. The cylindrical cavity has an apertured surface which emits light generated by the electrodeless lamp when excited by microwave energy.

Control over the electromagnetic field distribution is accomplished in a preferred embodiment of the invention by configuring the cylindrical cavity to support the $TE_{112}$ resonant mode. In this mode, an ascending portion of the electric field can be positioned adjacent the portion of an electrodeless lamp which would normally remain cooler, increasing the electric field intensity, thus raising the temperature of the normally cooler portion of the lamp.

In other embodiments of the invention, a local discontinuity is introduced in the cylindrical cavity wall, increasing the electric field intensity on the portion of the electrodeless lamp which normally runs cooler than the remaining portion of the lamp.

DESCRIPTION OF THE PREFERRED EMBODIMENT

Figure 1:
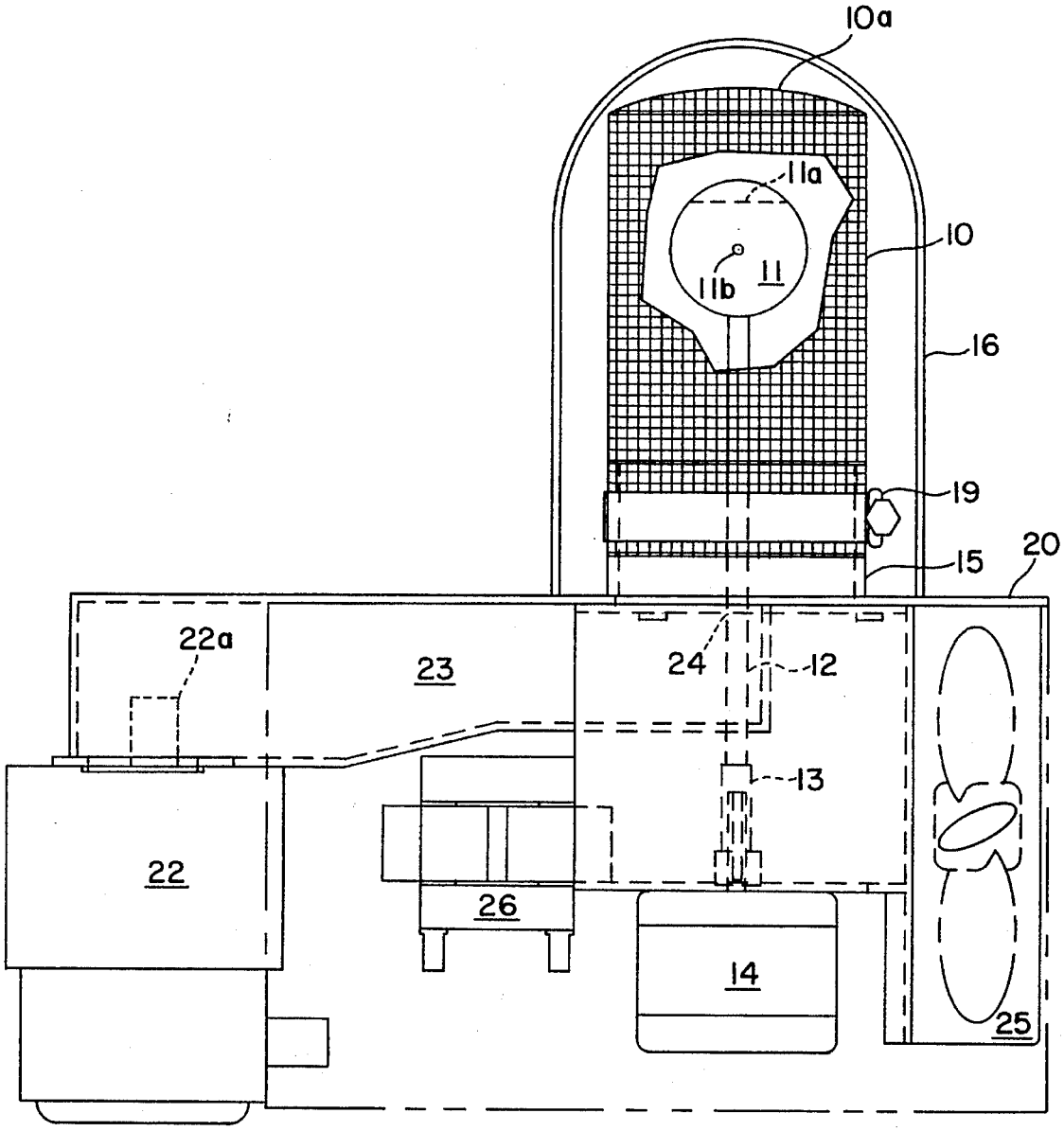
FIG. 1 is a plan view of an apparatus for generating light from an electrodeless bulb.
Figure 2:
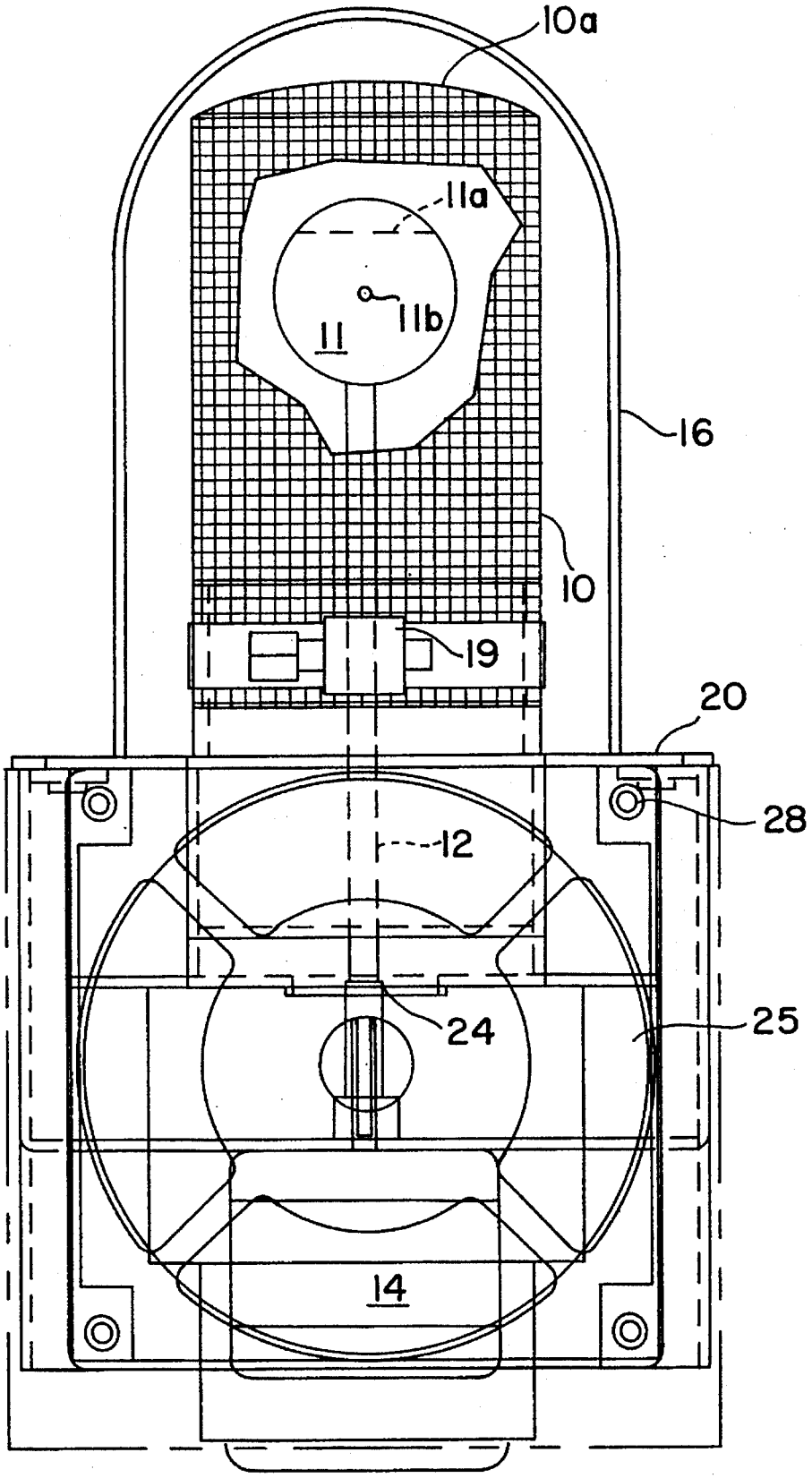
FIG. 2 is an end view of the apparatus of FIG. 1.
Figure 3:
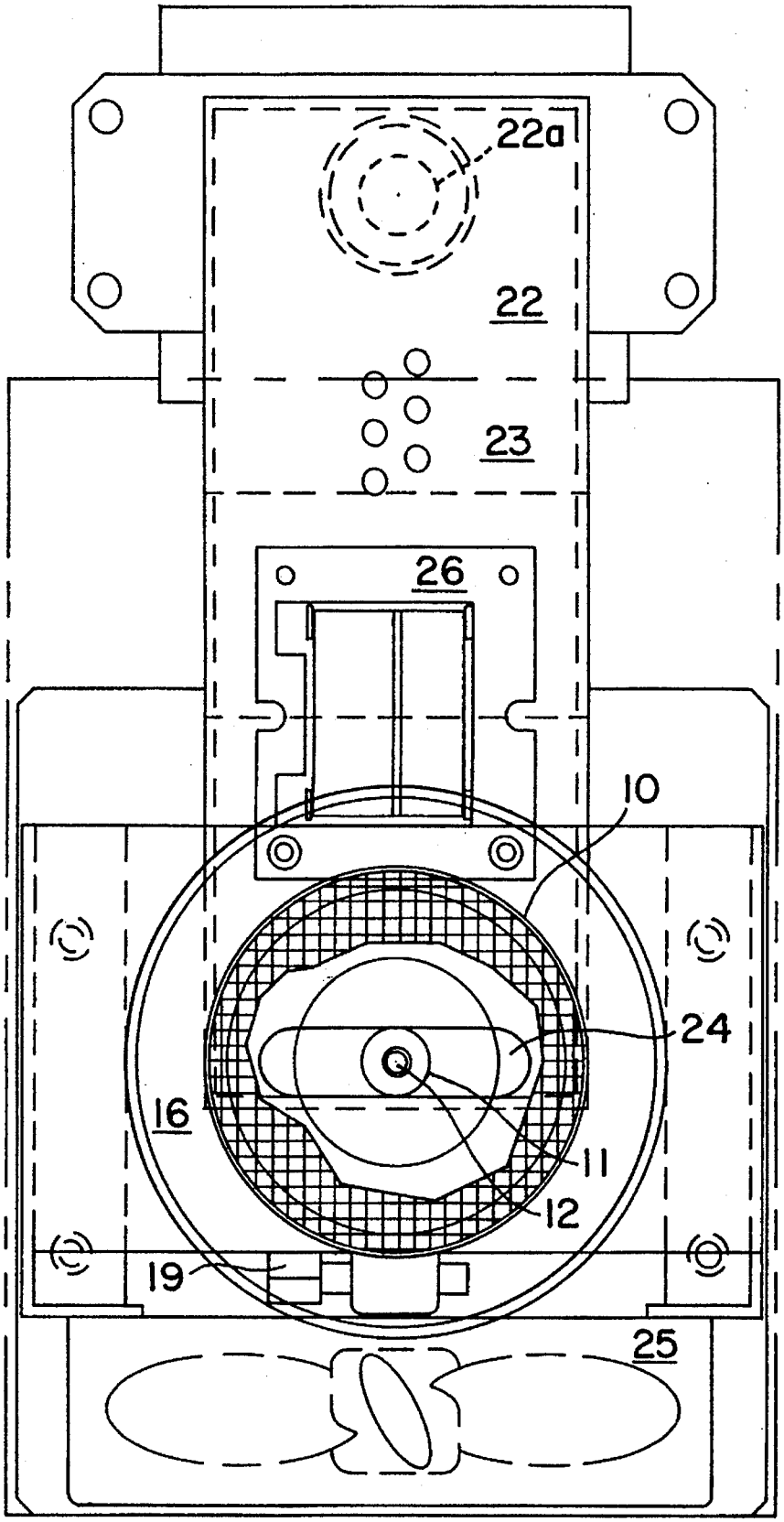
FIG. 3 is a top view of the apparatus of FIG. 1.

Referring to FIGS. 1, 2 and 3, there is shown respectively, plan, end and top views of an apparatus for generating light from an electrodeless lamp 11. The electrodeless lamp 11, in the preferred embodiment of the invention, contains either sulfur or selenium, which, when excited with microwave energy, generates primarily visible light. The apparatus of FIG. 1 includes a housing 20 which is open along the top, and which encloses a filament transformer 26 for providing filament current to a magnetron 22, a motor 14 for rotating an electrodeless lamp 11, and a cooling fan 25 for providing cooling air to the magnetron 22.

The magnetron 22 is a commercially available magnetron operating at approximately 2.45 GHz. The magnetron 22 has an antenna **22*a* coupled to a waveguide section 23 which enters the housing 20 and closes the top of housing 20. Waveguide section 23 couples the microwave energy from magnetron 22 to a longitudinal slot 24 on the top wall of the waveguide. Microwave energy coupled through slot 24 propagates along the longitudinal axis of cylindrical cavity 10 towards end 10*a***.

The electrodeless lamp 11 is supported on a shaft 12 which is coupled via coupling 13 to the motor 14. As is known in the electrodeless lamp art, rotation of the lamp 11 at several hundred RPM creates a uniform plasma in lamp 11, and provides circumferential temperature uniformity to the lamp 11, thus prolonging its life.

The electrodeless lamp 11 is shown inside cylindrical cavity 10 which may include an apertured surface to emit light from the lamp 11 while confining the electromagnetic radiation within the cylindrical cavity. The cylindrical cavity 10 has sidewalls and an end wall 10*a* which may be made from a metallic mesh or screen which emits light.

The apertured portion of the cavity 10 is clamped via a clamp 19 to cylindrical flange 15 bolted to the surface of the waveguide 23, forming the top of housing 20. A transparent protection dome 16 is placed over the cavity 10.

The lamp 11 includes a top portion 11*a* above the lamp center 11*b*, which is subject to a local temperature differential with respect to the remaining portion of the lamp 11. When a $TE_{111}$ mode is supported within the cavity 10, the electric field in the region of lamp portion 11*a* is decreasing in intensity, and microwave illumination of the lamp, particularly in the region 11*a*, is non-uniform, resulting in uneven heating of the lamp 11.

The sulfur or selenium molecules within the lamp 11 are unevenly heated and may produce a dark, light impermeable region in a portion 11*a* of lamp 11 above the center of the lamp 11*b*. This reduces the amount of light which is generated through portion 11*a*, decreasing total light output and making light output non-uniform over the surface of lamp 11. FIGS. 2 and 3 depict different views of the lamp 11 described in FIG. 1, where features identical to those in FIG. 1 are designated by the same reference numerals and are not further described herein.

Figure 4A:
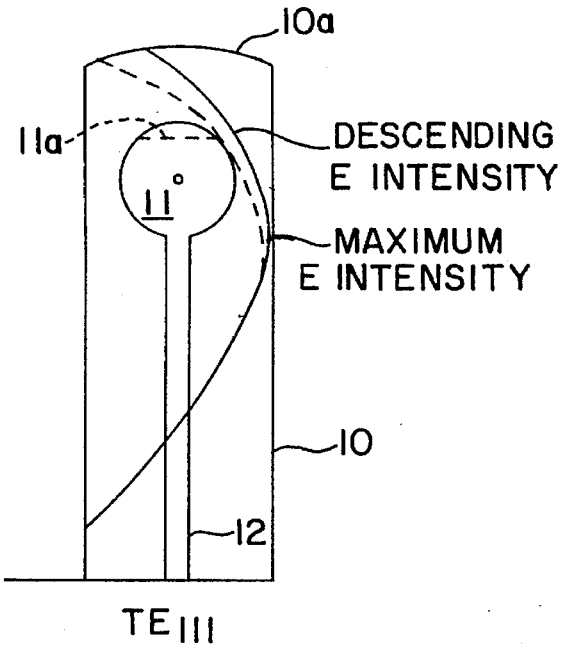
FIG. 4A PRIOR ART
FIG. 4A illustrates the electric field distribution within a cylindrical cavity when excited with a TE111 mode as is known in the prior art.

FIG. 4A illustrates the field distribution within the cylindrical cavity 10 which was used in the prior art which identifies the source of unequal heating of the lamp 11 supported on shaft 12. The solid line represents the sinusoidal electric field distribution of a $TE_{111}$ propagation mode supported within cylindrical cavity 10 with end 10*a* in the absence of a lamp. The portion of the $TE_{111}$ electric field distribution adjacent region 11*a*, is descending in electric field (E) strength with the maximum intensity below the lamp center 11(*b*). Less energy is thus absorbed by the electrodeless lamp in region 11*a*, resulting in a lower temperature than in the region opposite the ascending portion of the electric field distribution.

In the presence of the lamp, the broken line illustrates how the electric field strength rapidly reduces in the region 11*a*, resulting in a lower temperature, producing a light-absorbing gas in sulfur- and selenium-filled lamps. Light production in region 11*a* suffers due to the light absorbing gas.

Figure 4B:
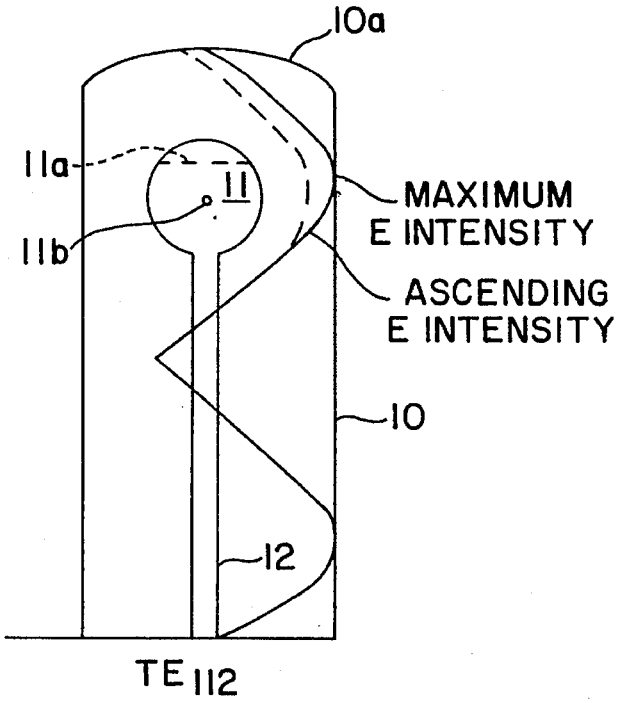
FIG. 4B illustrates the improved field distribution from a TE112 mode.

In accordance with a preferred embodiment of the invention, the cavity 10 is a cylindrical cavity having end 10*a* supporting a $TE_{112}$ propagation mode. The cylindrical cavity 10 may be configured in length and dimensions in accordance with a conventional mode chart for right circular cylindrical cavities as described in the text "Introduction to Microwave Theory and Measurements" to support a $TE_{112}$ propagation mode. The $TE_{112}$ mode, as shown in FIG. 4B, provides for an electric field distribution along the axis of the cylindrical cavity 10 with end 10*a* which has two sinusoidal peaks associated with it. The second sinusoidal peak is located such that an ascending increasing intensity of the electric field (E) is adjacent the region 11*a* of the electrodeless lamp 11 with shaft 12, increasing the electric field strength in the region 11*a* above the lamp center 11(*b*). The increased electric field intensity in this region increases the temperature of region 11*a*, reducing the amount of light absorbing gas which forms at the top of the electrodeless lamp 11*a*.

The length of the cylindrical cavity 10 is selected so that the lamp 11 may be supported on shaft 12 far enough away from the slot 24 to avoid coupling of the fringe field associated with slot 24 with the lamp 11 as shown for example in FIG 1.

The increased electric field at the top of the lamp provides a more uniform discharge and prevents the formation of sludge or higher order molecules which degrade the lamp's light generation efficiency. The rate of energy absorption, particularly in a sulfur plasma within the lamp, is increased near the top of the lamp, increasing plasma heating of the gas molecules.

In the $TE_{111}$ mode, positioning the bulb further down the cavity where the electric field intensity is rising would result in better heating of the top of the lamp. However, this would reduce the optical access to the lamp, and would promote near field interaction with the fringe fields produced at the boundary between the cylindrical cavity 10 and the slot 24 of the waveguide 24.

Other techniques for locally increasing the electric field intensity near the top of the lamp 11 are shown in FIGS. 5A, 5B, 6A, 6B, 7A and 7B. These techniques do not require the $TE_{112}$ resonant mode. These alternative techniques are illustrated using reference numerals which are common to the embodiment of FIGS. 1–3 and 4B.

Figure 5A:
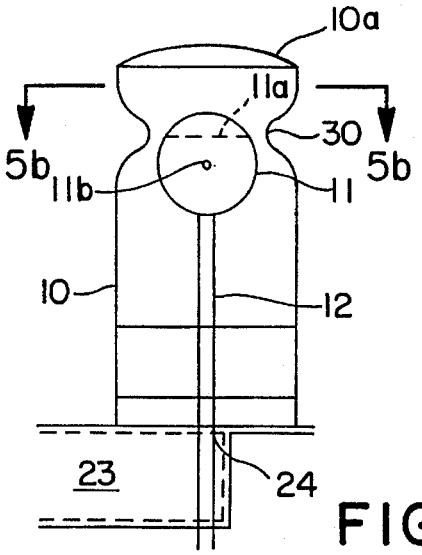
FIG. 5A is a section view of a cylindrical cavity having a restriction along its length for increasing the electric field near the top of an electrodeless lamp.
Figure 5B:
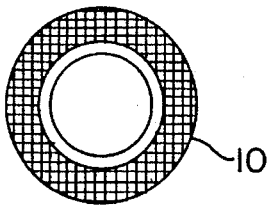
FIG. 5B is a top view of FIG. 5A.

FIGS. 5A and 5B show a narrowing of the cavity 10 in the region 11*a* (see FIG. 5A) of the lamp to create a restriction 30 (see FIG. 5A) for increasing the electric field intensity in region 11*a*.

Figure 6A:
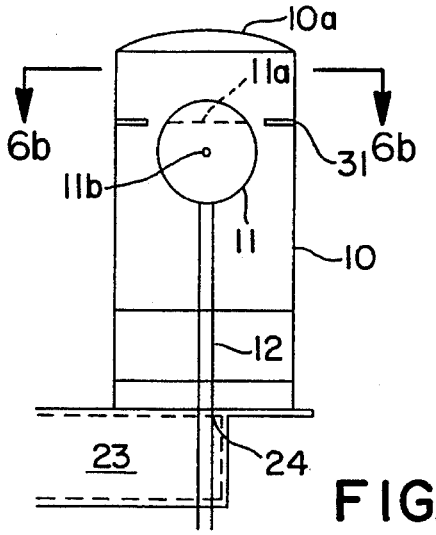
FIG. 6A illustrates an iris supported in the cylindrical cavity for increasing the electric field near the top of the electrodeless lamp.
Figure 6B:
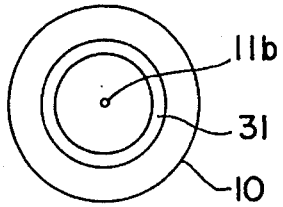
FIG. 6B is a top view of FIG. 6A.

FIGS. 6A and 6B illustrate an iris 31 which is located within the cylindrical cavity 10 at a location opposite region 11*a* (see FIG. 6A) for increasing the electric field intensity in the region above the lamp center 11*b*.

Figure 7A:
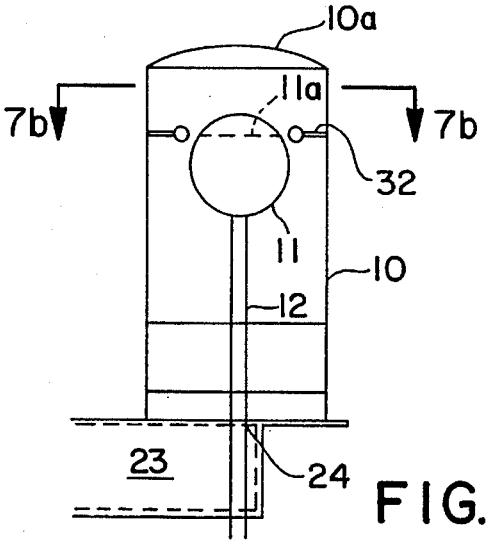
FIG. 7A illustrates a torroidal ring within the cylindrical cavity for increasing the electric field near the top of the electrodeless lamp.
Figure 7B:
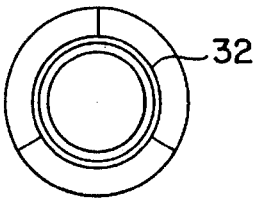
FIG. 7B is a section view of FIG. 7A.

FIGS. 7A and 7B illustrate the use of a suspended torroidal metallic ring 32 which increases the field intensity in the region 11*a* of the lamp 11 (see FIG. 7A).

Each of the foregoing embodiments achieves the objective of maintaining the lamp 11 sufficiently distant from the slot 24 to avoid coupling with the fringe field produced from the coupling slot 24. Further, the height of the lamp 11 from the housing 20 permits full optical access to the lamp.

Thus, there has been described with respect to several embodiments, a technique for efficiently illuminating an electrodeless bulb which avoids local temperature differentials in the bulb, thus increasing light output. Those skilled in the art will recognize yet other embodiments of the invention as described more fully by the claims which follow.

What is claimed is:

1. An apparatus for exciting an electrodeless lamp with microwave energy comprising:

a source of microwave energy;

a cylindrical cavity coupled to said source of microwave energy, having a plurality of light emitting apertures, said cylindrical cavity supporting microwave energy coupled from said source having an electric field which varies sinusoidally along an axis of said cylindrical cavity; and an electrodeless lamp supported for rotation on a motor driven shaft in said cylindrical cavity along the axis of said cavity at a location which is distant from a location which produces fringe fields from coupling said microwave source to said cylindrical cavity, and located so that a portion of said electrodeless lamp above a center of said electrodeless lamp is illuminated by a portion of said electric field which is increasing in intensity along the length of said cavity, whereby said electrodeless lamp has a surface area which is heated at a substantially constant temperature across the surface area thereof.

2. The apparatus for exciting an electrodeless lamp according to claim 1, wherein said cylindrical cavity includes a toroidal ring along the length of said cylindrical cavity for increasing said electric field intensity.

3. The apparatus for exciting an electrodeless lamp according to claim 1, wherein said cylindrical cavity has a length and diameter which support a $TE_{112}$ mode of operation.

4. The apparatus for exciting an electrodeless lamp according to claim 1, wherein said cylindrical cavity includes an iris along said length for creating said increasing electric field intensity.

5. An apparatus for producing high intensity visible light comprising:

a housing supporting at one end thereof a magnetron and at an opposite end thereof a cooling fan which supplies forced air to said magnetron, and further including a motor with a driven shaft extending through said housing;

an electrodeless lamp supported on said driven shaft; and, a light emitting cylindrical cavity supported on said housing, said cylindrical cavity enclosing said electrodeless lamp, and coupled through said housing to said magnetron, whereby microwave energy generated by said magnetron is coupled to said cavity, said cavity supporting an electric field which increases in intensity along a longitudinal axis of said cylindrical cavity in a region above a center of said lamp and adjacent an end of said electrodeless lamp, thereby decreasing local temperature variations in said lamp.

6. The apparatus of claim 5, wherein said cavity supports said microwave energy having an $TE_{112}$ mode.

7. The apparatus of claim 5, wherein said cavity includes means located above the center of said electrodeless lamp for increasing the electric field intensity in the region above said lamp center.

8. The apparatus of claim 7, wherein said means located above said lamp center includes a toroidal ring connected to said cavity.

9. The apparatus of claim 7, wherein said means located above said center of said lamp comprises a restriction for narrowing a width of said cavity.

10. The apparatus of claim 7, wherein said means located above said lamp center includes an iris in said cavity.

* * * * *